US012281572B1

(12) United States Patent
Sahu et al.

(10) Patent No.: US 12,281,572 B1
(45) Date of Patent: Apr. 22, 2025

(54) DETERMINING HYDROCARBON PRODUCTION FROM MULTIPLE SUBTERRANEAN FORMATIONS

(71) Applicant: Saudi Arabian Oil Company, Dhahran (SA)

(72) Inventors: Qasim Sahu, Sayhat (SA); Rajendra Arunkumar Kalgaonkar, Dhahran (SA); Vera Solovyeva, Moscow (RU)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/479,204

(22) Filed: Oct. 2, 2023

(51) Int. Cl.
*E21B 49/08* (2006.01)
*E21B 47/11* (2012.01)

(52) U.S. Cl.
CPC ..... *E21B 49/088* (2013.01); *E21B 47/11* (2020.05)

(58) Field of Classification Search
None
See application file for complete search history.

(56) References Cited

U.S. PATENT DOCUMENTS

| | | | |
|---|---|---|---|
| 8,960,294 | B2 | 2/2015 | Freese et al. |
| 9,284,833 | B2 | 3/2016 | Hewitt et al. |
| 10,415,382 | B2 | 9/2019 | Enkababian et al. |
| 10,961,445 | B2 | 3/2021 | Ogle et al. |
| 2007/0289739 | A1* | 12/2007 | Cooper ..... E21B 47/10 166/250.01 |
| 2009/0087912 | A1 | 4/2009 | Ramos et al. |
| 2012/0000658 | A1* | 1/2012 | Coludrovich, III ..... E21B 33/14 166/305.1 |

(Continued)

FOREIGN PATENT DOCUMENTS

| | | |
|---|---|---|
| CN | 104018822 | 9/2016 |
| CN | 113374462 | 9/2021 |

OTHER PUBLICATIONS

Agenet et al., "Fluorescent Nanobeads: a First Step Toward Intelligent Water Tracers," presented at the SPE International Oilfield Oilfield Nanotechnology Conference, Noordwijk, The Netherlands, Jun. 12-14, 2012, 13 pages.

(Continued)

*Primary Examiner* — Andrew Sue-Ako
(74) *Attorney, Agent, or Firm* — Fish & Richardson P.C.

(57) ABSTRACT

A system and a method for determining hydrocarbon production from multiple subterranean formations. Different nanotag tracers are sequentially injected into subterranean production zones fluidly coupled to a wellbore extending from a surface of the Earth through the subterranean production zones. The respective nanotag tracers are injected into a respective subterranean production zone. The different nanotag tracers and production fluids contained within the subterranean production zones are produced through the wellbore to the surface. A turbidity of the production fluids containing the different nanotag tracers is determined at the surface. A quantity of each of the one or more different nanotag tracers from each of the subterranean production zones in the production fluids is determined. Based on the turbidity of the production fluids and the quantity of the different nanotag tracers, a total oil production rate from the subterranean production zones is determined.

18 Claims, 4 Drawing Sheets

(56) References Cited

U.S. PATENT DOCUMENTS

| | | | | |
|---|---|---|---|---|
| 2012/0142111 | A1 | 6/2012 | Tour et al. | |
| 2016/0024904 | A1* | 1/2016 | Zupanick | E21B 43/305 166/50 |

OTHER PUBLICATIONS alluxa.com [online], "Flow Cytometry Filters," available on or before Nov. 29, 2019, via Internet Archive: Wayback Machine URL <https://web.archive.org/web/20240501001743/https://alluxa.com/optical-filter-applications/flow-cytometry-filters/>, retrieved on Apr. 30, 2024, URL <https://alluxa.com/optical-filter-applications/flow-cytometry-filters/>, 9 pages.

Asadi et al., "Post-Frac Analysis Based on Flowback Results Using Chemical Frac-Tracers," presented at the International Petroleum Technology Conference, KualaLumpur, Malaysia, Dec. 3-5, 2008, 13 pages.

Li et al., "Fracture Quantitative Characterization Using Tracer Flowback for Multistage Fracturing Horizontal Well in Tight Oil," presented at the SPE Russian Petroleum Technology Conference and Exhibition, Moscow, Russia, Oct. 24-26, 2016, 10 pages.

Liu et al., "Modeling tracer flowback behaviour for a multifractures horizontal well in a tight oil reservoir using the embedded discrete fracture model," Journal of Petroleum Science and Engineering, May 2022, 16 pages.

Mahmoud et al., "Advancement of Hydraulic Fracture Diagnostics in Unconventional Formations," Geofluids, Nov. 2021, 17 pages.

Munoz et al., "Long-Term Post-Frac Performance Analysis Based on Flowback Analysis Using Chemical Frac-Tracers," presented at the SPE Latin American and Caribbean Petroleum Engineering Conference, Cartagena, Colombia, May 31-Jun. 3, 2009, 13 pages.

Salman et al., "Analysis of Chemical Tracer Flowback in Unconventional Reservoirs," presented at the SPE/CSUR Unconventional Resources Conference, Calgary, Alberta, Canada, Sep. 30-Oct. 2, 2014, 22 pages.

vision-systems.com [online], "Sensor and camera requirements for hyperspectral imaging," available on or before Oct. 19, 2020, via Internet Archive: Wayback Machine URL <https://web.archive.org/web/20240501002601/https://www.vision-systems.com/cameras-accessories/article/14181365/hyperspectral-imaging-sensor-and-camera-requirements>, retrieved on Apr. 30, 2024, URL <https://www.vision-systems.com/cameras-accessories/article/14181365/hyperspectral-imaging-sensor-and-camera-requirements>, 14 pages.

Woodroof et al., "Monitoring Fracturing Fluid Flowback and Optimizing Fracturing Fluid Cleanup Using Chemical Frac Tracers," presented at the SPE European Formation Damage Conference, The Hague, The Netherlands, May 13-14, 2003, 12 pages.

* cited by examiner

DETERMINING HYDROCARBON PRODUCTION FROM MULTIPLE SUBTERRANEAN FORMATIONS

TECHNICAL FIELD

This disclosure relates hydrocarbon wellbore production analysis.

BACKGROUND OF THE DISCLOSURE

Wellbores in an oil and gas well receive and flow production fluids from multiple subterranean production zones of the Earth and conduct the production fluids to a surface of the Earth. The production fluids can include both liquid and gaseous phases of various fluids and chemicals including water and hydrocarbon liquids and gases. The productions fluids may flow the different subterranean production zones at different rates and have different quantities of the various fluids and chemicals.

SUMMARY

This disclosure describes technologies related determining hydrocarbon production from multiple subterranean formations. Implementations of the present disclosure include determining, based on the turbidity of production fluids and a quantity of each of one or more different nanotag tracers, a total oil production rate from the subterranean production zones.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION OF THE DISCLOSURE

Figure 1A:
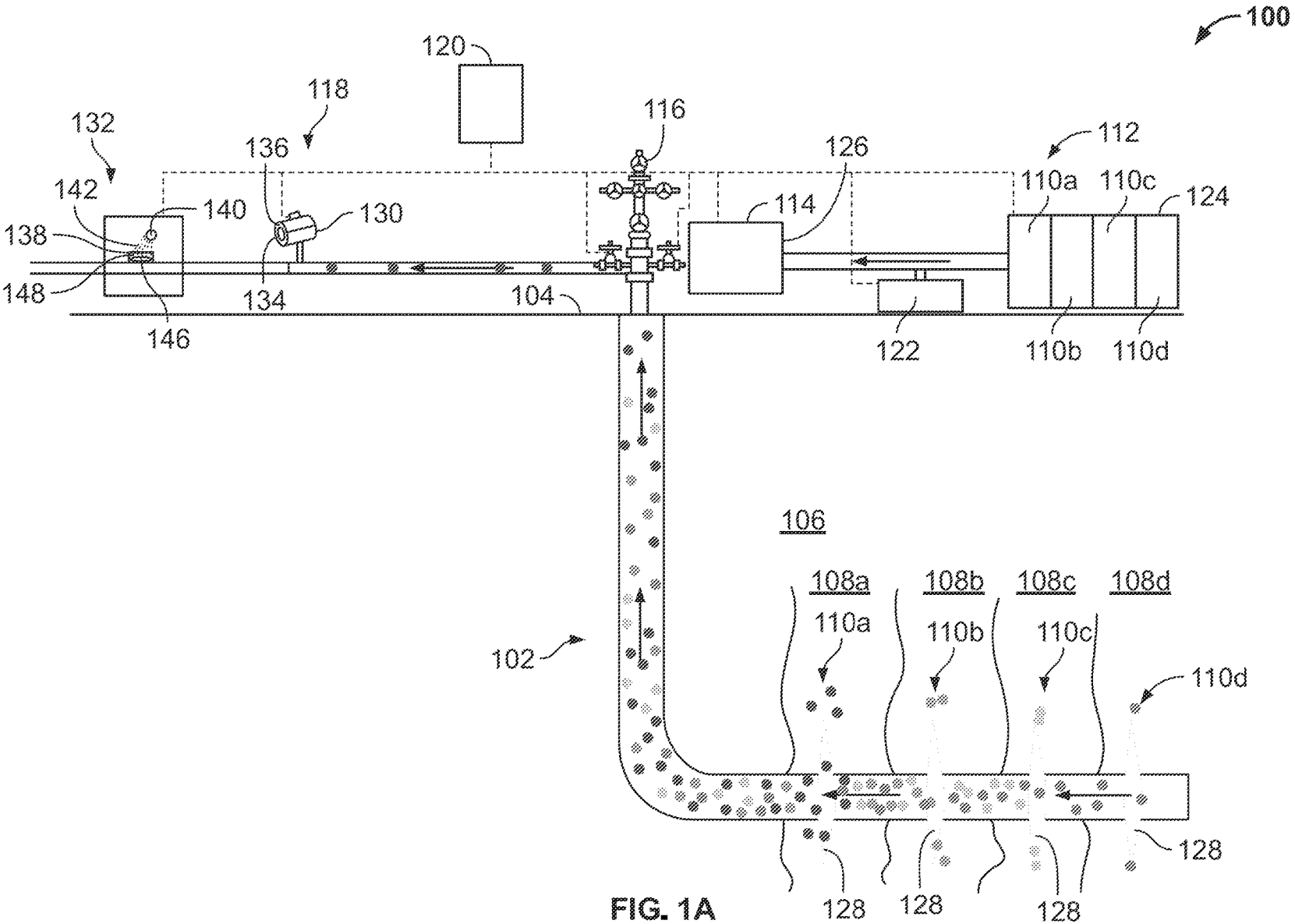
FIG. 1A is a schematic view of a hydrocarbon production system coupled to a wellbore.

The present disclosure relates to a method of determining hydrocarbon production from multiple subterranean formations based on a turbidity of the production fluids and a quantity of different nanotag tracers from each of the different subterranean formations. The hydrocarbons are produced from a wellbore fluidly coupled to multiple subterranean production zones. The wellbore extends from a surface of the Earth to the subterranean production zones. The hydrocarbon production from the subterranean formations is determined by sequentially injecting the different nanotag tracers into the subterranean production zones, producing the nanotag tracers and production fluids from the subterranean production zones to the surface, determining the turbidity of the production fluids containing the different nanotag tracers, determining the quantity of each of the one or more different nanotag tracers from each of the subterranean production zones in the production fluids, and determining, based on the turbidity of the production fluids and the quantity of each of the one or more different nanotag tracers, a total oil production rate from the plurality of subterranean production zones.

Implementations of the present disclosure realize one or more of the following advantages. Hydrocarbon production flow analysis from multiple subterranean production formations can be improved. For example, production from different subterranean production formations can differ, decreasing accuracy of analysis methods. Injecting different nanotag tracers into different subterranean formations, producing the subterranean formations, and based on the count of the nanotag tracers and turbidity of the production flow, the total oil production rate from the subterranean production zones and the contribution from each of the subterranean production zones can be determined. For example, by continually determining the turbidity of the production fluid flow from the wellbore and continually counting nanotag tracers in the production fluid flow from the wellbore with the nanotag tracer and fluid analysis system, the total oil production rate and the individual oil production rate from each of the subterranean production zones can be determined in real-time.

Wellbore production of hydrocarbons from the subterranean production zones can be improved. For example, identifying which subterranean productions zones are producing hydrocarbons and water, and then quantify the production coming from each of the subterranean production zones, can improve future hydraulic fracturing treatment planning and operations to optimize which and how different subterranean production zones are to be hydraulically fractured, improving wellbore production.

Wellbore logging operations can be simplified. For example, by utilizing a continuous measurement of subterranean production zones, the need to run a production logging tool can be eliminated, simplifying wellbore logging operations.

Subterranean producing formation evaluation can be improved. For example, evaluating a performance of well can be improved by measuring fluid entering the wellbore from each of the subterranean producing formations, improving production evaluation from subterranean producing formations.

FIG. 1A is a schematic view of a hydrocarbon production system 100 coupled to a wellbore 102. The wellbore 102 extends from a surface 104 of the Earth 106 to multiple different subterranean production zones 108*a*, 108*b*, 108*c*, and 108*d*. Each of the subterranean production zones 108*a*, 108*b*, 108*c*, and 108*d* are fluidly coupled to the wellbore 102 through perforations 128. The wellbore 102 receives fluids such as hydrocarbons and water from the subterranean production zones 108*a*, 108*b*, 108*c*, and 108*d* and conduct the hydrocarbons and water to the surface 104. At the surface, the hydrocarbon production system 100 determines a turbidity of the production fluids and counts different nanotag tracers 110*a*, 110*b*, 110*c*, and 110*d* which have been injected into each of the different subterranean production zones 108*a*, 108*b*, 108*c*, and 108*d*, respectively. Based on the turbidity of the production fluids and the count of each of the different nanotag tracers 110*a*, 110*b*, 110*c*, and 110*d*, the hydrocarbon production system 100 determines the individual oil production rate from each of the subterranean production zones 108*a-d* and the total oil production rate from the wellbore 102.

The hydrocarbon production system 100 has a nanotag tracer injection system 112, a surface pump 114 coupled to the nanotag tracer injection system 112 and the wellbore 102 by a wellhead 116, a nanotag tracer and fluid analysis system 118, and a controller 120. The nanotag tracer injection system 112 delivers fracturing fluid and different nanotag fluids to the surface pump 114. The surface pump 114 receives the fracturing fluid and the different nanotag fluids from the nanotag tracer injection system 112 and flows the fracturing fluid and the different nanotag fluids into the wellbore 102 through the wellhead 116 and into the different subterranean production zones 108*a-d*, described in detail in reference to FIG. 1B. The wellbore 102 conducts the hydrocarbons, water, and different nanotag tracers 110*a-d* from the subterranean production zones 108*a-d* to the surface 104 and the tracer and fluid analysis system 118. The tracer and fluid analysis system 118 determines the turbidity of the production fluids received from the wellbore 102 and counts the different nanotag tracers 110*a-d* and sends signals representing the turbidity of the production fluids and the count of the different nanotag tracers 110*a-d* to the controller 120. Based on the turbidity of the production fluids and the count of the different nanotag tracers 110*a-d*, the controller 120 determines the individual oil production rate from each of the subterranean production zones 108*a-d* and the total oil production rate from the wellbore 102.

The nanotag tracer injection system 112 includes a fracturing liquid tank 122 containing a fracturing liquid and multiple nanotag tracer fluid tanks 124. The fracturing liquid tank 122 is fluidly coupled a suction 126 of the surface pump 114.

Each of the nanotag tracer fluid tanks 124 containing the different nanotag tracer fluids 110*a-d*. The nanotag tracer fluid tanks 124 are fluidly coupled to the suction 126 of the surface pump 114. The nanotag tracer fluid tanks 124 provide the nanotag tracers 110*a-d* sequentially (that is, one nanotag tracer fluid 110*a-d* at a time), so each different nanotag tracer fluid 110*a-d* can be injected into different subterranean production zones 108*a-d*. The nanotag tracers are water-based florescent nano-particles which fluoresce when exposed to a light, such as a ultra-violet light. By injecting the different nanotag tracers 110*a-d* into the different subterranean production zones 108*a-d*, which subterranean production zones 108*a-d* is producing during flow back of the wellbore 102 can determined and identified qualitatively. Each of the different nanotag tracers 110*a-d* have different florescent barcoded tags which will be injected in the different subterranean production zones 108*a-d* (stages of the wellbore 102) during the fracturing treatment (injecting the fracturing liquid and the different nanotag fluids 110*a-d*). The different nanotag tracers 110*a-d* are mixed at a known concentration in the fracturing fluid tanks 124 and pumped downhole into the wellbore 102 sequentially. For example, when the wellbore 102 is completed with four stages corresponding to each of the four subterranean production zones 108*a-d*, the nanotag tracer fluid 110*d* will be injected into the subterranean production zone 108*d*, the nanotag tracer fluid 110*c* will be injected into the subterranean production zone 108*c*, the nanotag fluid 110*b* will be injected into the subterranean production zone 108*b*, and the nanotag tracer fluid 110*a* will be injected into the subterranean production zone 108*a* sequentially.

To satisfy various fracturing conditions based on each of the subterranean production formations 108*a-d*, several types of fluorescent nanomaterials with sizes from <10 nm up to 500 nm can be used in the nanotag fluids 110*a-d* for the tracing of productivity of zonal production of the fractured wellbore 102. In some cases, the nanotag tracers 110*a-d* can include fluorescent quantum dots dispersed in the fracturing fluid. Multiple compositions of a core of the quantum dots, as well as variety of sizes can provide distinct color of fluorescent emission, which would then be injected into the different subterranean production zones 108*a-d*. For example, various combinations of quantum dots can include: carbon quantum dots, perovskite quantum dots, silicon quantum dots, metals-based quantum dots including CdX (X=ZnO, Se, FeS,ZnS), InP, $CuInS_2$, InP/ZnSeS/ZnS, PbS, PbO, ZnO, ZnS, HgS, GaAs, GaP, AlGaAs HgTe, InAs InP, $CuInS_2$, InP/ZnSeS/ZnS, PbS, PbO, ZnO, ZnS, HgS, GaAs, GaP, AlGaAs HgTe, InAs, or other core-shell and multi-shell quantum dots.

For representative production monitoring, nanotags tracers 110*a-d* in the form of a stable dispersion are injected. Some quantum dot nanoparticles are stabilized in the injection fluid, by treating the quantum dots with additives such as surfactants. Alternatively or in addition, the nanoparticles can be embedded into a polymer or a silica matrix for additional stabilization.

Pumping the stable dispersion of the quantum dot nanoparticles (the nanotag tracers 110*a-d*) of one color emitting material with the fracturing fluid to a specific subterranean production zone 108*a-d* can result in the tagging of that zone (that specific subterranean production zone 108*a-d*) with a nanotag tracer 110*a-d* of specific color. Thus, productivity of the specific subterranean production zone 108*a-d* would be proportional to fluorescent emission wavelength of the respective nanotag tracer 110*a-d*.

In other cases, the nanotag tracers 110*a-d* can include nanoparticles of fluorescent metal-organic frameworks and/or covalent-organic frameworks to be injected with the fracturing fluid into the subterranean production formations 108*a-d*. The nanoparticles of fluorescent metal-organic frameworks and/or covalent-organic frameworks have porous structures, which can increase buoyancy and distribution in low-density injection fluids.

In yet other examples, the nanotag tracers 110*a-d* can include persistent luminescent nanobeads (PLN) to differentiate background fluorescence of production fluid from fluorescence of fluorescent nanotags via a time-resolved luminescence. The following list of PLNs can be used as emitting barcoded tags: $Ca_{0.2}Zn_{0.9}Mg_{0.9}Si_2O_6:Eu^{2+}$, $Dy^{3+}$, $Mn^{2+}$; $CaMgSi_2O_6:Eu^{2+}$, $Mn^{2+}$, $Pr^{3+}$; $Sr_{1.6}Mg_{0.3}Zn_{1.1}Si_2O_7:Eu^{2+}$, $Dy^{3+}$; $Ca_{1.86}Mg_{0.14}ZnSi_2O_7:Eu^{2+}$, $Dy^{3+}$; $Sr_2MgSi_2O_7:Eu^{2+}$, $Dy^{3+}$; $LiGa_5O^8:Cr^{3+}$; $Zn_{2.94}Ga_{1.96}Ge_2O_{10}:Cr^{3+}$, $Pr^{3+}$; $Zn_{1.1}Ga_{1.8}Ge_{0.1}O_4:Cr^{3+}$; $ZnGa_2O_4:Cr^{3+}$; $ZnGa_2O_4$:Cr, Eu; $Zn_2SO_4$:Cr, Eu; $Zn_{1+x}Ga_{2-2x}Ge_xO_4$:Cr; $ZnGa_2O_4:Cr^{3+}$; or $Zn_{1.25}Ga_{1.5}Ge_{0.25}O_4:Cr^{3+}$, $Yb^{3+}$, $Er^{3+}$. Surface modification and encapsulation of PLN into hydrophilic polymer of silica shell can provide better dispersion and lack of aggregation for the PLN-nanoparticles.

Multi-shell PLN, such as $SiO_2$@$ZnGa_2O_4$:Cr@$SiO_2$ and polyethylene glycol-functionalized $SrAl_2O_4:Eu^{2+}$ can be used. These multi-shell PLNs are water-dispersible and transportable in water-based liquid flow.

Specific barcoded signature nanotag tracers 110*a-d* can be created by embedding the nanoparticles onto a carrier-matrix to provide unique spectral characteristic of the tag. The sequence of colors of specific different nanotag tracers 110*a-d* can then be selected according to the number of fracturing stages (subterranean production zones 108*a-d*). In some cases, a difference in the emission wavelengths of applied tags can be at least 30 nm for detection resolution.

The surface pump 114 is fluidly coupled to the fracturing liquid tank 122 and the nanotag tracer fluid tanks 124. The surface pump 114 receives the fracturing fluid and the sequentially introduced different nanotag tracer fluids 110*a-d* and injects the fracturing fluid and the contained different nanotag tracer fluids 110*a-d* through the wellhead 116, through the wellbore 102, and into the respective subterranean production zones 108*a-d*. The nanotag tracers 110*a-d* can be injected with the fracturing fluid to penetrate deep inside the each of the respective subterranean production zones 108*a-d* and flow into and fractures and rock matrix because a size of the nanotag tracers 10*a-d* is smaller than a pore throat size of the rock matrix. The different nanotag tracers 110*a-d* remain in the rock matrix and the fractures of the respective subterranean production zones 108*a-d* until the wellbore 102 is produced.

Figure 1B:
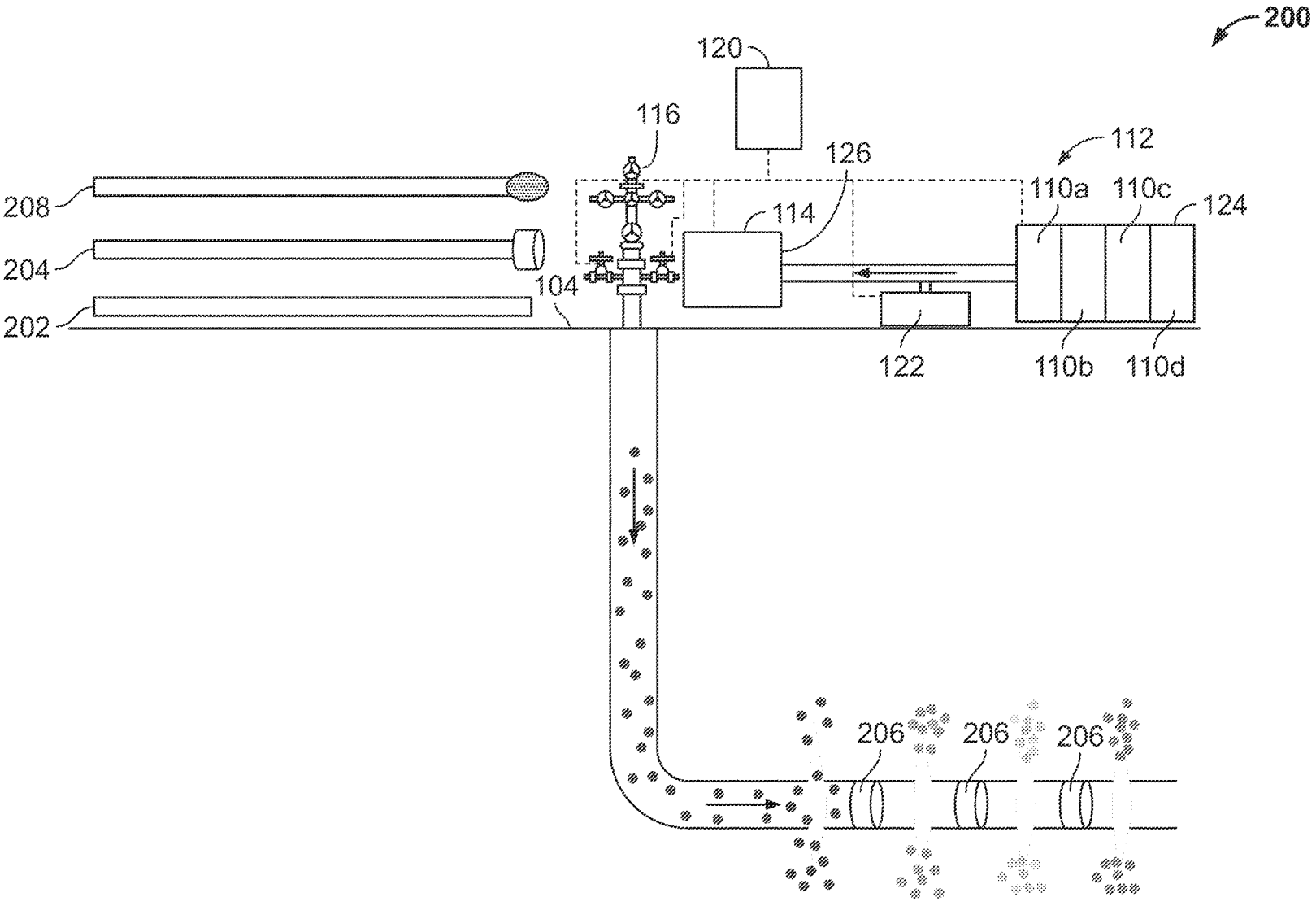
FIG. 1B is a schematic view of a nanotag tracer injection system coupled to the wellbore of FIG. 1A.

FIG. 1B is a schematic view of a nanotag tracer injection system 200 coupled to the wellbore 102 of FIG. 1A. The nanotag tracer injection system 200 includes the surface pump 114, the fracturing liquid tank 122, and the multiple nanotag tracer fluid tanks 124.

The nanotag tracer injection system 200 can include a perforation bottom hole assembly 202. The perforation bottom hole assembly 202 can be disposed in the wellbore 102 to perforate the wellbore 102, forming the perforations 128 and fluidically coupling each of the subterranean production zones 108*a-d* to the wellbore 102.

The nanotag tracer injection system 200 can include an isolation plug bottom hole assembly 204 to position isolation plugs 206 in the wellbore. The isolation plugs 206 can be placed in wellbore 102 between each of the perforations 128, isolating flow from the subterranean production zones 108*a-d* and stopping flow of hydrocarbons and water in the wellbore 102. The perforation bottom hole assembly 202 can be disposed in the wellbore 102 to perforate the wellbore 102, forming the perforations 128 and fluidically coupling each of the subterranean production zones 108*a-d* to the wellbore 102.

The nanotag tracer injection system 200 can include a mill bottom hole assembly 208 to mill out the isolation plugs 206 positioned in the wellbore. Milling out one or more of the isolation plugs 206 in the wellbore 102 can initiate flow from the isolated section of the wellbore 102, allowing flow from the respective isolated subterranean production zone 108*a-d*.

Referring to FIG. 1A, the nanotag tracer and fluid analysis system 118 has a nanotag tracer sensor 130 and a turbidity sensor 132 to sense conditions of the nanotag tracers 110*a-d* and the production fluid flow and send signals representing the sensed conditions to the controller 120. The nanotag tracer and fluid analysis system 118 senses the conditions of the nanotag tracers 110*a-d* and the produced fluids to determine the turbidity of the production fluids received from the wellbore 102 and the counts the different nanotag tracers 110*a-d* and sends signals representing the turbidity of the production fluids and the count of the different nanotag tracers 110*a-d* to the controller 120.

The nanotag tracer sensor 130 detects the nanotag tracers 110*a-d* in the flow of production fluids from the wellbore 102. The nanotag tracer sensor 130 includes a source 134 and a detector 136.

The source 134 of the nanotag tracer sensor 130 can be an irradiation source. The irradiation source 134 is positioned to transmit electromagnetic waves at the production fluid flow. For example, the irradiation source 134 can be an ultraviolet lamp, a light emitting diode laser, a near infrared laser, or an X-ray transmitter.

The detector 136 receives one or more of a fluorescent emission response and a luminescent emission response from the production fluid flow. Each emission response is a count and a frequency of one of the respective nanotag tracers 110*a-d*. The nanotag tracer sensor 130 transmits a signal representing the count and frequency (which is proportional to the production fluid flow) to the controller 120. The detector 136 can be an ultraviolet camera, a fluorimetric detector, a time-resolved fluorimetric detector, a hyperspectral imaging camera, or a multispectral imaging camera. In some cases, the detector 136 is capable of detecting specific wavelength characteristics for emissions from each of the different nanotag tracers 110*a-d*; recording specific wavelength characteristics for each of the different nanotag tracer emissions; and quantifying the specific wavelength characteristics for each of the different nanotag tracer emissions.

The hydrocarbon production system 100 can include a flow cytometry system. In some cases, the nanotag tracer sensor 130 is the flow cytometry system. The flow cytometry system receives a portion of the production flow containing the various nanotag fluids 110*a-d* produced at different rates from the subterranean production zones 108*a-d*, counts the nanotags in the nanotag fluids 110*a-d*, and transmits a signal representing the count of the nanotags in the nanotag fluids 110*a-d* to the controller 120. The flow cytometry system has a flow cell, a forward scatter detector, a side scatter detector to count the nanotags in the nanotag fluids 110*a-d*. The flow cytometry system sends signals representing the count of the nanotags in the production flow to the controller 120.

The flow cell conducts a portion of the production fluid flow containing fluids from one or more of the subterranean production zones 108*a-d* (hydrocarbons and water) and the respective of nanotag tracer fluids 110*a-d*. The flow cell is positioned to receive electromagnetic waves from the irradiation source 134 at an interrogation point. Responsive to receiving the electromagnetic waves from the irradiation source 134 at the interrogation point, the nanotags emit the fluorescent emission at the specific frequency.

The forward scatter detector is positioned to receive a portion of the fluorescent emission response and a luminescent emission response from the portion of the production fluid flow containing fluids from one or more of the subterranean production zones and the respective nanotag tracer fluids.

The side scatter detector is positioned to receive another portion of the fluorescent emission response and a luminescent emission response from another portion of the fluorescent emission response and a luminescent emission response from the portion of the production fluid flow containing fluids from one or more of the subterranean production zones and the respective nanotag tracer fluids. The side scatter detector includes multiple dichroic filters. Each of the dichroic filters are each coupled to a different fluorescence channel to count the different fluorescent emission responses and luminescent emission responses. This is one example of how the nanotag tracer sensor 130, when configured as a flow cytometry system, is capable of detecting specific wavelength characteristics for emissions from each of the different nanotag tracers 110*a-d*; recording specific wavelength characteristics for each of the different nanotag tracer emissions; and quantifying the specific wavelength characteristics for each of the different nanotag tracer emissions.

The nanotag tracer and fluid analysis system can include a hyperspectral camera. The hyperspectral camera is an example of a detector 136 of the nanotag tracer sensor 130.

The hyperspectral camera has a slit, a prism grating, and an image sensor. The hyperspectral camera receives the emissions from the nanotag fluids 110*a-d* and counts the emissions. The emissions pass through the slit and are dispersed along an axis by the prism grating. The dispersed emissions are received by the image sensor which senses a wavelength of the emission and transmits a signal representing the wavelength of the emission to the controller 120. The image sensor can be an InGaAs area image sensor.

The turbidity sensor 132 has a transparent capillary 138, a light source 140 positioned to transmit light 142 onto the transparent capillary 138, and a light detector 146. The light detector 146 is positioned relative to the light source 140 and the transparent capillary 138 to receive the light 142 from the light source 140 that has passed through the transparent capillary 138. A portion of the production fluid passes through the transparent capillary 138. As the production fluid passes through the transparent capillary 138, the light source 140 transmits the light 142 into and through the production fluid. Some of the light 142 is blocked by the production fluid and so only a portion 148 is received by the light detector 146. The ratio of the transmitted light 142 to the portion 148 received light at the light detector 146 is proportional to the turbidity of the production fluid. The turbidity sensor 132 transmits a signal representing the ratio of the transmitted light 142 to the received light at the light detector 146 to the controller 120. In some cases, the transparent capillary 138 is fluidly coupled to the production flow such that the portion of the production flow passes through the transparent capillary 138 in parallel with the flow of the production fluids.

The controller 120 is operatively coupled to the components of the hydrocarbon production system 100. The controller 120 receives signals representing conditions of the hydrocarbon production system 100, and based on the conditions, determines the individual oil production rate from each of the subterranean production zones 108*a-d* and the total oil production rate from the wellbore 102. The hydrocarbon production from the subterranean production zones 108*a-d* is determined by sequentially injecting the different nanotag tracers 110*a-d* into the subterranean production zones 108*a-d*, producing the nanotag tracers 110*a-d* and production fluids from the subterranean production zones 108*a-d* to the surface 104, determining the turbidity of the production fluids containing the different nanotag tracers 110*a-d*, determining the quantity of each of the one or more different nanotag tracers 110*a-d* from each of the subterranean production zones 108*a-d* in the production fluids, and determining, based on the turbidity of the production fluids and the quantity of each of the one or more different nanotag tracers 110*a-d*, the total oil production rate from the plurality of subterranean production zones.

The controller 120 determines, at the surface, the turbidity of the flow of production fluids containing the different nanotag tracers 110*a-d* by directing a flow of the production fluid through the transparent capillary 138 and sensing a level or intensity of light passed through the production fluid in the transparent capillary 138. The controller 120 directs the light source 140 to transmit the light 142 onto and through the transparent capillary 138. The production fluid in the transparent capillary 138 blocks some of the light, so only the portion of the received light 148 is received by the light detector 146. The light detector 146 transmits a signal to the controller 120 representative of the received light 148 to the controller 120. The controller 120 receives the signal representing the received light 148. The controller 120 compares the level and intensity of the light transmitted through the transparent capillary 138 with a threshold intensity to obtain a comparison result. Based on the comparison result, the controller 120 determines the turbidity of the flow of the production fluids. The threshold intensity can be the intensity of light transmitted through a sample of clear water passed through the transparent capillary 138.

The controller 120 can determine, based on the turbidity of the flow of production fluids and the quantity of each of the one or more different nanotag tracers, the total oil production rate from the subterranean production zones 108*a-d* by training a dataset of solutions with various turbidities relative to total oil production rates and expected quantities of each of the one or more different nanotag tracers 110*a-d*. In some cases, the turbidity of the production fluids is proportional to the total oil production rate from the subterranean production zones 108*a-d*.

Training can be accomplished by using color identification algorithm and training the model with lab data. For example, lab data can include different ratios of solution that contain the produced fluid and different concentration for each of the nanotag tracers 110*a-d*.

The controller 120 can determine a specific input of each of the subterranean production zones 108*a-d* to the total oil production rate from the subterranean production zones 108*a-d* by comparing the quantification of the specific wavelength characteristics for each of the nanotag tracers 110*a-d* emissions to the intensity of light passed through the production fluids; and based on the result of the comparison, determine a specific input of each of the subterranean production zones 108*a-d* to the total oil production rate from the subterranean production zones 108*a-d*. In some cases, detecting specific wavelength characteristics for each of the different nanotag tracers 110*a-d* emissions includes detecting an ultra-violet light characteristic for each of the different nanotag tracers 110*a-d* emissions. For example, the nanotag tracer sensor 130 can transmit UV light, sense the emission, and transmit the signal representing the count of each emission to the controller 120.

The controller 120, can determine that a quantity of the respective different nanotag tracers 110*a-d* remain in the respective subterranean production zone 108*a-d* indicating the respective subterranean production zone is not contributing to the total oil production rate. For example, based on determining the specific input of each of the subterranean production zones 108*a-d* to the total oil production rate from the subterranean production zones 108*a-d* can include comparing the specific input of each of the subterranean production zones 108*a-d* to an expected oil production rate from each of the subterranean production zones 108*a-d*. Based on the result of the comparison, the controller 120 can determine that a quantity of the respective different nanotag tracers 110*a-d* remain in the respective subterranean production zone 108*a-d* indicating the respective subterranean production zone 108*a-d* is not contributing to the total oil production rate.

The controller 120 can receive the signals from the flow cytometry system and determine a quantity of each of the one or more different nanotag tracers 110*a-d* from each of the subterranean production zones 108*a-d* in the flow of production fluids. Based on signals received from the forward scatter detector and the side scatter detector representing the conditions of the production fluid flow containing fluids from one or more of the subterranean production zones 108*a-d* and the respective nanotag tracer 110*a-d* fluids, the controller 120 can determine a quantity of each of the one or more different nanotag tracers 110*a-d* from each of the subterranean production zones 108*a-d* in the flow of production fluids.

The controller 120 can determining a flowback efficiency of each of the subterranean production zones 108*a-d*. The controller 120 can, based on determining the specific input of each of the subterranean production zones and the quantity of the respective different nanotag tracers remain in the respective subterranean production zone, determine the flowback efficiency of each of the subterranean production zones.

The controller 120 can determining a cleanup efficiency of a cleanup operation on the wellbore 102. The controller 120 can, after a cleanup operation has been performing on the wellbore 102, can determine a specific input of each of the subterranean production zones 108*a-d* and the quantity of the respective different nanotag tracers 110*a-d* remain in the respective subterranean production zone 108*a-d*. Based on the specific input of each of the subterranean production zones 108*a-d* and the quantity of the respective different nanotag tracers 110*a-d* remain in the respective subterranean production zone 108*a-d*, the controller 120 can determine the cleanup efficiency of the cleanup operation.

Figure 1C:
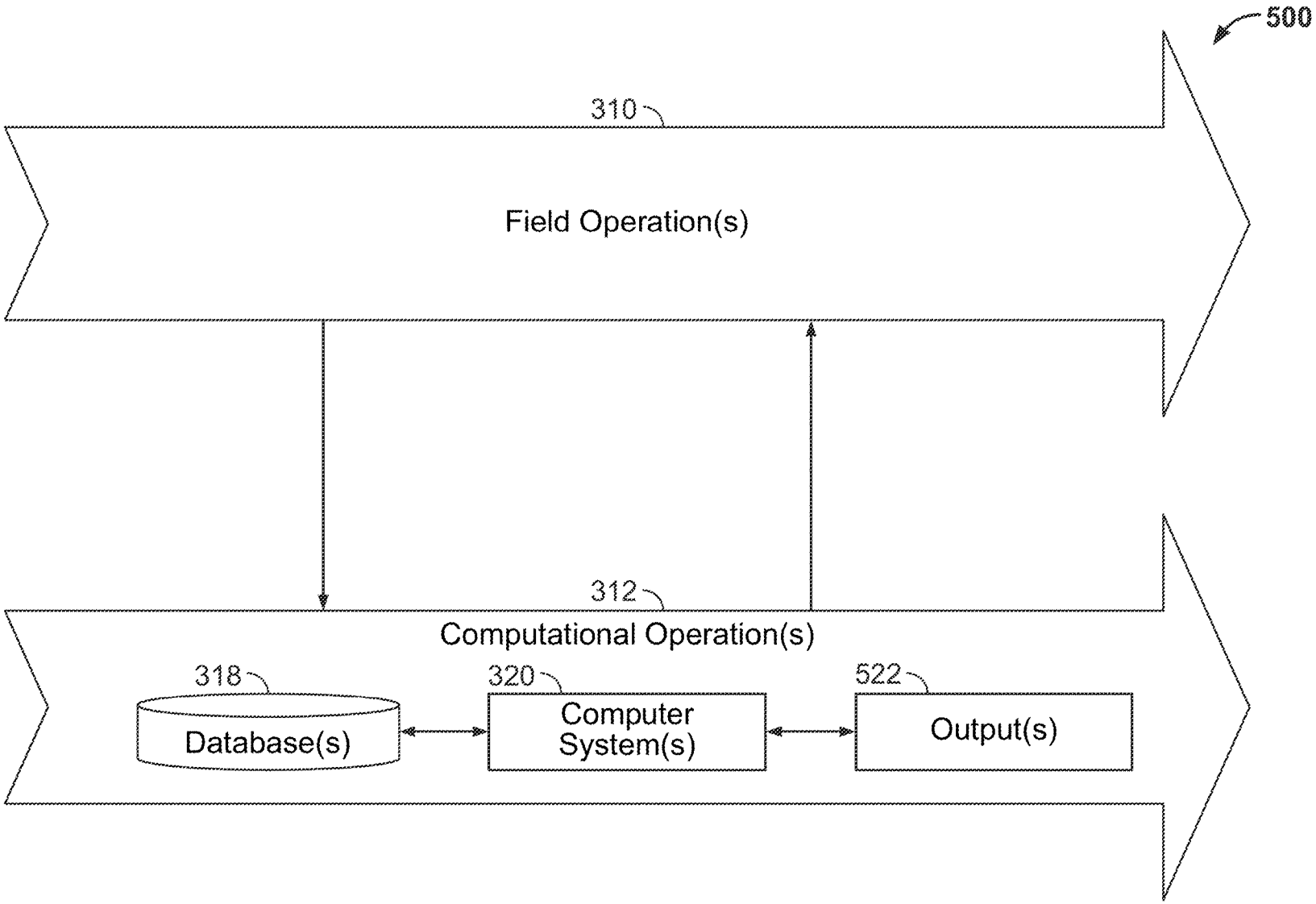
FIG. 1C illustrates hydrocarbon production operations that include both one or more field operations and one or more computational operations, which exchange information and control hydrocarbon production analysis for the production of hydrocarbons.

FIG. 1C illustrates hydrocarbon production operations 300 that include both one or more field operations 510 and one or more computational operations 312, which exchange information and control exploration for the production of hydrocarbons. In some implementations, outputs of techniques of the present disclosure can be performed before, during, or in combination with the hydrocarbon production operations 300, specifically, for example, either as field operations 310 or computational operations 312, or both.

Examples of field operations 310 include forming/drilling a wellbore, hydraulic fracturing, producing through the wellbore, injecting fluids (such as water) through the wellbore, to name a few. In some implementations, methods of the present disclosure can trigger or control the field operations 310. For example, the methods of the present disclosure can generate data from hardware/software including sensors and physical data gathering equipment (e.g., seismic sensors, well logging tools, flow meters, and temperature and pressure sensors). The methods of the present disclosure can include transmitting the data from the hardware/software to the field operations 310 and responsively triggering the field operations 310 including, for example, generating plans and signals that provide feedback to and control physical components of the field operations 310. Alternatively or in addition, the field operations 310 can trigger the methods of the present disclosure. For example, implementing physical components (including, for example, hardware, such as sensors) deployed in the field operations 310 can generate plans and signals that can be provided as input or feedback (or both) to the methods of the present disclosure.

Examples of computational operations 312 include the controller 120 which can have one or more computer systems 320 that include one or more processors and computer-readable media (e.g., non-transitory computer-readable media) operatively coupled to the one or more processors to execute computer operations to perform the methods of the present disclosure. The computational operations 312 can be implemented using one or more databases 318, which store data received from the field operations 310 and/or generated internally within the computational operations 312 (e.g., by implementing the methods of the present disclosure) or both. For example, the one or more computer systems 320 process inputs from the field operations 310 to assess conditions in the physical world, the outputs of which are stored in the databases 318. For example, the nanotag tracer sensor 130 and turbidity sensors 132 of the field operations 310 can be used to determines the individual oil production rate from each of the subterranean production zones 108*a-d* and the total oil production rate from the wellbore 102. The source and received signals are provided to the computational operations 312 where they are stored in the databases 318 and analyzed by the one or more computer systems 320.

In some implementations, one or more outputs 322 generated by the one or more computer systems 320 can be provided as feedback/input to the field operations 310 (either as direct input or stored in the databases 318). The field operations 310 can use the feedback/input to control physical components used to perform the field operations 310 in the real world.

For example, the computational operations 312 can process the data from the nanotag tracer sensor 130 and the turbidity sensor 132 to determine the individual oil production rate from each of the subterranean production zones 108*a-d* and the total oil production rate from the wellbore 102.

The one or more computer systems 320 can update the individual oil production rate from each of the subterranean production zones 108*a-d* and the total oil production rate from the wellbore 102. as information from the nanotag tracer sensor 130 and the turbidity sensor 132. Similarly, the data received from production operations can be used by the computational operations 312 to control components of the production operations. For example, production well and pipeline data can be analyzed to determines the individual oil production rate from each of the subterranean production zones 108*a-d* and the total oil production rate from the wellbore 102. and the computational operations 312 can control machine operated valves such as the wellhead 116.

In some implementations of the computational operations 312, customized user interfaces can present intermediate or final results of the above-described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or app), or at a central processing facility.

The presented information can include feedback, such as changes in parameters or processing inputs, that the user can select to improve a production environment, such as in the exploration, production, and/or testing of petrochemical processes or facilities. For example, the feedback can include parameters that, when selected by the user, can cause a change to, or an improvement in, drilling parameters (including drill bit speed and direction) or overall production of a gas or oil well. The feedback, when implemented by the user, can improve the speed and accuracy of calculations, streamline processes, improve models, and solve problems related to efficiency, performance, safety, reliability, costs, downtime, and the need for human interaction.

In some implementations, the feedback can be implemented in real-time, such as to provide an immediate or near-immediate change in operations or in a model. The term real-time (or similar terms as understood by one of ordinary skill in the art) means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second(s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart or are located in different countries or other jurisdictions.

Figure 2:
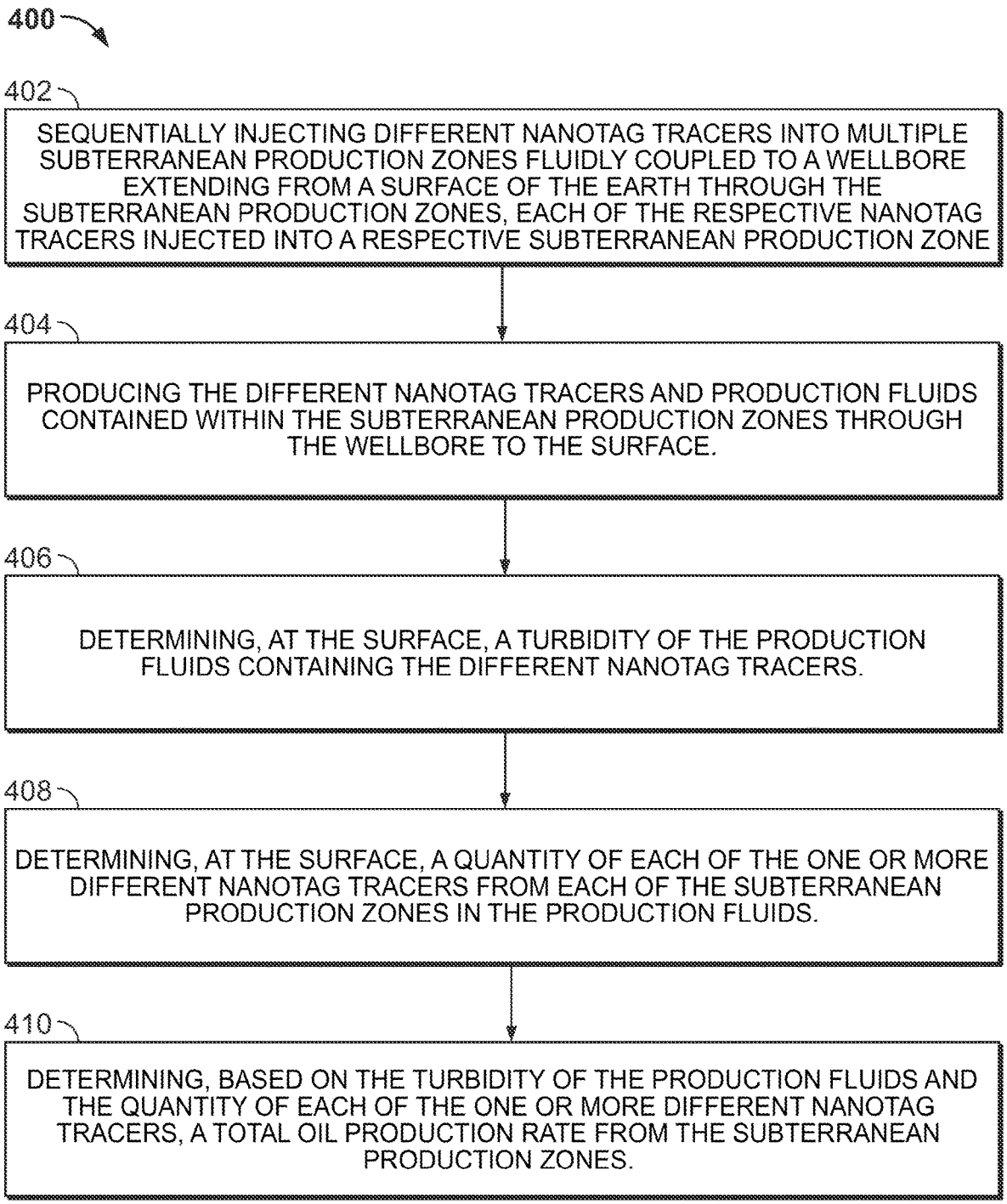
FIG. 2 is a flow chart of an example method of determining hydrocarbon production from multiple subterranean formations.

FIG. 2 is a flow chart of an example method 400 of determining hydrocarbon production from multiple subterranean formations. At 402, sequentially injecting different nanotag tracers into multiple subterranean production zones fluidly coupled to a wellbore extending from a surface of the Earth through the subterranean production zones. Each of the respective nanotag tracers are injected into a respective subterranean production zone. For example, referring to FIGS. 1A-1B, after subterranean producing zone 108*d* has been perforated and no other subterranean producing formations (i.e., subterranean producing zone 108*a-c*) have not been perforated and no isolation plugs 206 are in the wellbore 102, the controller 120 generates command signals to the nanotag tracer injection system 112 to provide the nanotag tracer 110*d* from the nanotag tracer fluid tanks 124 along with fracturing fluid from the fracturing liquid tank 122 and the surface pump 114 to inject the nanotag tracer 110*d* and the fracturing fluid into the wellbore 102 through the wellhead 116 and into the subterranean producing zone 108*d* to fracture the subterranean producing zone 108*d* and impregnate the subterranean producing zone 108*d* with the nanotag tracers 110*d*. Next, at isolation plug 206 is placed in the wellbore 102 by the isolation plug bottom hole assembly 204 between subterranean production zone 108*d* and subterranean production zone 108*c*, isolating production fluid and nanotag tracer 110*d* flow in the subterranean producing zone 108*d*. Subterranean production zone 108*c* is then perforated by the perforation bottom hole assembly 202. Then, the controller 120 generates command signals to the nanotag tracer injection system 112 to provide the nanotag tracer 110*c* from the nanotag tracer fluid tanks 124 along with fracturing fluid from the fracturing liquid tank 122 and the surface pump 114 to inject the nanotag tracer 110*c* and the fracturing fluid into the wellbore 102 through the wellhead 116 and into the subterranean production zone 108*c* to fracture the subterranean production zone 108*c* and impregnate the subterranean production zone 108*c* with the nanotag tracers 110*c*.

At 404, the different nanotag tracers and production fluids contained within the subterranean production zones are produced through the wellbore to the surface. For example, referring to FIG. 1B, the milling bottom hole assembly 208 is disposed in the wellbore 102 to remove the isolation plugs 206 and valves in the wellhead 116 are opened, initiating flow from the subterranean production zones 108*a-d* to the surface 104 though the wellbore 102.

At 406, at the surface, a turbidity of the production fluids containing the different nanotag tracers is determined. In some implementations, determining, at the surface, the turbidity of the production fluids containing the different nanotag tracers includes flowing a portion of the production fluids through a transparent capillary at the surface; transmitting a light onto the portion of the production fluids in the transparent capillary; detecting an intensity of the light transmitted through the transparent capillary; comparing the intensity of the light transmitted through the transparent capillary with a threshold intensity to obtain a comparison result; and based on the comparison result, determining the turbidity of the production fluids. In some cases, the threshold intensity is the intensity of light transmitted through a sample of clear water passed through the transparent capillary. In some cases, flowing the portion of the flow of the production fluids includes flowing the portion of the flow of the production fluids in parallel with the flow of production fluid at the surface. For example, referring to FIG. 1A, some of the production fluids pass through the transparent capillary 138 and the turbidity sensor 132 determines the turbidity of the production fluids.

At 408, at the surface, a quantity of each of the one or more different nanotag tracers from each of the subterranean production zones in the production fluids is determined. In some implementations, determining the quantity of each of the one or more different nanotag tracers from each of the subterranean production zones in the flow of production fluids includes detecting specific wavelength characteristics for emissions from each of the different nanotag tracers; recording specific wavelength characteristics for each of the different nanotag tracers emissions; quantifying the specific wavelength characteristics for each of the different nanotag tracers emissions; comparing the quantification of the specific wavelength characteristics for each of the nanotag tracers emissions to the intensity of light passed through the production fluids; and based on the result of the comparison, determining a specific input of each of the subterranean production zones to the total oil production rate from the subterranean production zones. In some cases, detecting specific wavelength characteristics for each of the different nanotag tracers emissions includes detecting an ultra-violet light characteristic for each of the different nanotag tracers emissions. For example, referring to FIGS. 1A and 1B, the nanotag tracer sensor 130 can be an ultra-violet laser to interrogate the nanotag tracers 110*a-d* and a hyperspectral camera to count the emissions.

At 410, based on the turbidity of the production fluids and the quantity of each of the one or more different nanotag tracers, a total oil production rate from the subterranean production zones is determined.

In some implementations, determining the total oil production rate from the subterranean production zones includes training a dataset of solutions with various turbidities relative to total oil production rates and expected quantities of each of the one or more different nanotag tracers. In some case, the turbidity of the production fluids is proportional to the total oil production rate from the subterranean production zones.

In some implementations, based on determining the specific input of each of the subterranean production zones to the total oil production rate from the subterranean production zones further includes comparing the specific input of each of the subterranean production zones to an expected oil production rate from each of the subterranean production zones; and based on the result of the comparison, determining that a quantity of the respective different nanotag tracers remain in the respective subterranean production zone indicating the respective subterranean production zone is not contributing to the total oil production rate.

In some implementations, based on the determining a specific input of each of the subterranean production zones and the quantity of the respective different nanotag tracers remain in the respective subterranean production zone, determining a flowback efficiency of each of the subterranean production zones.

In some implementations, the method further includes performing a cleanup operation on the wellbore; and based on the determining a specific input of each of the subterranean production zones and the quantity of the respective different nanotag tracers remain in the respective subterranean production zone, determining a cleanup efficiency of the cleanup operation.

In some implementations, before sequentially injecting the different nanotag tracers into the subterranean production zones fluidly coupled to a wellbore before injecting, a casing of the wellbore is perforated. When the casing is perforated, each of the subterranean production zones are fluidly coupled to the wellbore. Sequentially injecting the different nanotag tracers into the subterranean production zones can then include sequentially injecting the different nanotag tracers into the subterranean production zones through the perforations, hydraulically fracturing the subterranean production zones sequentially.

In some implementations, sequentially hydraulically fracturing the one or more of the plurality of production zones to inject the different nanotag tracers into the production zones includes after sequentially hydraulically fracturing each of the one or more production zones from a downhole production zone to an uphole production zone relative to the downhole production zone in an uphole direction toward the surface, placing a plug in the wellbore between the downhole production zone and the uphole production zone to seal the wellbore; and initiating the flow of production fluids from the subterranean production zones into wellbore to the surface comprises milling the plug positioned in the wellbore.

Embodiments

In an example aspect, a method includes sequentially injecting multiple different nanotag tracers into multiple subterranean production zones fluidly coupled to a wellbore extending from a surface of the Earth through the subterranean production zones, each of the respective nanotag tracers injected into a respective subterranean production zone; producing the different nanotag tracers and production fluids contained within the subterranean production zones through the wellbore to the surface; determining, at the surface, a turbidity of the production fluids containing the different nanotag tracers; determining, at the surface, a quantity of each of the one or more different nanotag tracers from each of the subterranean production zones in the production fluids; and determining, based on the turbidity of the production fluids and the quantity of each of the one or more different nanotag tracers, a total oil production rate from the subterranean production zones.

In an example aspect combinable with any other example aspect, determining, at the surface, the turbidity of the production fluids containing the different nanotag tracers can include flowing a portion of the production fluids through a transparent capillary at the surface; transmitting a light onto the portion of the production fluids in the transparent capillary; detecting an intensity of the light transmitted through the transparent capillary; comparing the intensity of the light transmitted through the transparent capillary with a threshold intensity to obtain a comparison result; and based on the comparison result, determining the turbidity of the production fluids.

In an example aspect combinable with any other example aspect, the threshold intensity is the intensity of light transmitted through a sample of clear water passed through the transparent capillary.

In an example aspect combinable with any other example aspect, flowing the portion of the flow of the production fluids can include flowing the portion of the flow of the production fluids in parallel with the flow of production fluid at the surface.

In an example aspect combinable with any other example aspect, determining, based on the turbidity of the flow of production fluids and the quantity of each of the one or more different nanotag tracers, the total oil production rate from the plurality of subterranean production zones includes training a dataset of solutions with various turbidities relative to total oil production rates and expected quantities of each of the one or more different nanotag tracers. A recognition of turbidity of production fluids can be proportional to the total oil production rate from the subterranean production zones.

In an example aspect combinable with any other example aspect, determining the quantity of each of the one or more different nanotag tracers from each of the subterranean production zones in the flow of production fluids can include detecting specific wavelength characteristics for emissions from each of the different nanotag tracers; recording specific wavelength characteristics for each of the different nanotag tracers emissions; quantifying the specific wavelength characteristics for each of the different nanotag tracers emissions; comparing the quantification of the specific wavelength characteristics for each of the nanotag tracers emissions to the intensity of light passed through the production fluids; and based on the result of the comparison, determining a specific input of each of the subterranean production zones to the total oil production rate from the subterranean production zones.

In an example aspect combinable with any other example aspect, detecting specific wavelength characteristics for each of the different nanotag tracers emissions can include detecting an ultra-violet light characteristic for each of the different nanotag tracers emissions.

In an example aspect combinable with any other example aspect, based on determining the specific input of each of the subterranean production zones to the total oil production rate from the subterranean production zones can include comparing the specific input of each of the subterranean production zones to an expected oil production rate from each of the subterranean production zones; and based on the result of the comparison, determining that a quantity of the respective different nanotag tracers remain in the respective subterranean production zone indicating the respective subterranean production zone is not contributing to the total oil production rate.

In an example aspect combinable with any other example aspect, the method can include, based on the determining a specific input of each of the subterranean production zones and the quantity of the respective different nanotag tracers remain in the respective subterranean production zone, determining a flowback efficiency of each of the subterranean production zones.

In an example aspect combinable with any other example aspect, the method can include performing a cleanup operation on the wellbore; and based on the determining a specific input of each of the subterranean production zones and the quantity of the respective different nanotag tracers remain in the respective subterranean production zone, determining a cleanup efficiency of the cleanup operation.

In an example aspect combinable with any other example aspect, the method can include, before sequentially injecting the different nanotag tracers into the subterranean production zones fluidly coupled to a wellbore before injecting, the method can further include perforating a casing of the wellbore; and responsive to perforating the casing, fluidly coupling each of the subterranean production zones to the wellbore. Sequentially injecting the different nanotag tracers into the subterranean production zones can include sequentially injecting the different nanotag tracers into the subterranean production zones through the perforations, hydraulically fracturing the subterranean production zones sequentially.

In an example aspect combinable with any other example aspect, sequentially hydraulically fracturing one or more of the production zones to inject the different nanotag tracers into the production zones can include after sequentially hydraulically fracturing each of the production zone from a downhole production zone to an uphole production zone relative to the downhole production zone in an uphole direction toward the surface, placing a plug in the wellbore between the downhole production zone and the uphole production zone to seal the wellbore. Initiating the flow of production fluids from the subterranean production zones into wellbore to the surface can include milling the plug positioned in the wellbore.

In another example aspect, a system includes a nanotag tracer injection system, a surface pump, a controller, and a nanotag tracer and fluid analysis system. The nanotag tracer injection system includes a fracturing liquid tank containing a fracturing liquid and multiple nanotag tracer fluid tanks fluidly coupled to the fracturing liquid tank. Each of the nanotag tracer fluid tanks contain a different nanotag tracer fluid. The surface pump is coupled to the fracturing fluid tank and configured the flow the fracturing fluid and the nanotag tracer fluid into a wellbore extending from the surface of the Earth through multiple subterranean production zones. The nanotag tracer and fluid analysis system includes a sensor at a surface of the Earth. The sensor is positioned to sense a condition of a production fluid flow from the wellbore. The production fluid flow contains fluids from one or more of the subterranean production zones and the respective nanotag tracer fluids. The controller is operably coupled to the nanotag tracer injection system, the surface pump, and the nanotag tracer and fluid analysis system. The controller is configured to perform operations including sequentially injecting the different nanotag tracer fluids from the nanotag tracer fluid tanks into the subterranean production zones; controlling a flow of the different nanotag tracer fluids and production fluids contained within one or more of the subterranean production zones through the wellbore to the surface; determining a turbidity of the flow of production fluids containing the different nanotag tracers at the surface; determining a quantity of each of the one or more different nanotag tracers from each of the subterranean production zones in the flow of production fluids at the surface; and determining, based on the turbidity of the flow of production fluids and the quantity of each of the one or more different nanotag tracers, a total oil production rate from the subterranean production zones.

In an example aspect combinable with any other example aspect, the sensor can include a transparent capillary; a light source positioned to transmit light onto the transparent capillary; a light detector positioned relative to the light source and the transparent capillary to receive light from the light source that has passed through the transparent capillary. The controller can be further configured to perform operations including determining, at the surface, the turbidity of the flow of production fluids containing the different nanotag tracers by: controlling a flow a portion of the flow of production fluids at the surface through the transparent capillary; transmitting a light onto the flow of production fluids in the transparent capillary; detecting an intensity of the light transmitted through the transparent capillary; comparing the intensity of the light transmitted through the transparent capillary with a threshold intensity to obtain a comparison result; and based on the comparison result, determining the turbidity of the flow of the production fluids.

In an example aspect combinable with any other example aspect, the threshold intensity is the intensity of light transmitted through a sample of clear water passed through the transparent capillary.

In an example aspect combinable with any other example aspect, flowing the portion of the flow of the production fluids can include flowing the portion of the flow of the production fluids in parallel with the flow of production fluid at the surface.

In an example aspect combinable with any other example aspect, determining, based on the turbidity of the flow of production fluids and the quantity of each of the one or more different nanotag tracers, the total oil production rate from the subterranean production zones can include training a dataset of solutions with various turbidities relative to total oil production rates and expected quantities of each of the one or more different nanotag tracers. A recognition of turbidity of production fluids can be proportional to the total oil production rate from the subterranean production zones.

In an example aspect combinable with any other example aspect, determining the quantity of each of the one or more different nanotag tracers from each of the subterranean production zones in the flow of production fluids can include detecting specific wavelength characteristics for emissions from each of the different nanotag tracers; recording specific wavelength characteristics for each of the different nanotag tracers emissions; quantifying the specific wavelength characteristics for each of the different nanotag tracers emissions; comparing the quantification of the specific wavelength characteristics for each of the nanotag tracers emissions to the intensity of light passed through the production fluids; and based on the result of the comparison, determining a specific input of each of the subterranean production zones to the total oil production rate from the subterranean production zones.

In an example aspect combinable with any other example aspect, detecting specific wavelength characteristics for each of the different nanotag tracers emissions can include detecting an ultra-violet light characteristic for each of the different nanotag tracers emissions.

In an example aspect combinable with any other example aspect, based on determining the specific input of each of the subterranean production zones to the total oil production rate from the subterranean production zones can include comparing the specific input of each of the subterranean production zones to an expected oil production rate from each of the subterranean production zones; and based on the result of the comparison, determining that a quantity of the respective different nanotag tracers remain in the respective subterranean production zone indicating the respective subterranean production zone is not contributing to the total oil production rate.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A method comprising:

sequentially injecting a plurality of different nanotag tracers into a plurality of subterranean production zones fluidly coupled to a wellbore extending from a surface of the Earth through the plurality of subterranean production zones, each of the respective nanotag tracers injected into a respective subterranean production zone;

producing the different nanotag tracers and production fluids contained within the subterranean production zones through the wellbore to the surface;

determining, at the surface, a turbidity of the production fluids containing the different nanotag tracers;

determining, at the surface, a quantity of each of the one or more different nanotag tracers from each of the plurality of subterranean production zones in the production fluids; and determining, based on the turbidity of the production fluids and the quantity of each of the one or more different nanotag tracers, a total oil production rate from the plurality of subterranean production zones by training a dataset of solutions with various turbidities relative to total oil production rates and expected quantities of each of the one or more different nanotag tracers, wherein the turbidity of the production fluids is proportional to the total oil production rate from the subterranean production zones.

2. The method of claim 1, wherein determining, at the surface, the turbidity of the production fluids containing the different nanotag tracers comprises:

flowing a portion of the production fluids through a transparent capillary at the surface;

transmitting a light onto the portion of the production fluids in the transparent capillary;

detecting an intensity of the light transmitted through the transparent capillary;

comparing the intensity of the light transmitted through the transparent capillary with a threshold intensity to obtain a comparison result; and based on the comparison result, determining the turbidity of the production fluids.

3. The method of claim 2, wherein the threshold intensity is the intensity of light transmitted through a sample of clear water passed through the transparent capillary.

4. The method of claim 2, wherein flowing the portion of the production fluids comprises flowing the portion of the production fluids in parallel with a flow of production fluids at the surface.

5. The method of claim 1, wherein determining the quantity of each of the one or more different nanotag tracers from each of the plurality of subterranean production zones in the production fluids comprises:

detecting specific wavelength characteristics for emissions from each of the plurality of different nanotag tracers;

recording specific wavelength characteristics for the emissions from each of the plurality of different nanotag tracers;

quantifying the specific wavelength characteristics for the emissions from each of the plurality of different nanotag tracers;

comparing the quantification of the specific wavelength characteristics for the emissions from each of the plurality of different nanotag tracers to an intensity of light passed through the production fluids; and based on the result of the comparison, determining a specific input of each of the subterranean production zones to the total oil production rate from the subterranean production zones.

6. The method of claim 5, wherein detecting specific wavelength characteristics for the emissions from each of the plurality of different nanotag tracers comprises detecting an ultra-violet light characteristic for the emissions from each of the plurality of different nanotag tracers.

7. The method of claim 5, further comprising:

after determining the specific input of each of the subterranean production zones to the total oil production rate from the subterranean production zones, comparing the specific input of each of the subterranean production zones to an expected oil production rate from each of the subterranean production zones; and based on the result of the comparison, determining that a quantity of the respective different nanotag tracers remain in the respective subterranean production zone indicating the respective subterranean production zone is not contributing to the total oil production rate.

8. The method of claim 7, further comprising, based on determining the specific input of each of the subterranean production zones and the quantity of the respective different nanotag tracers remaining in the respective subterranean production zone, determining a flowback efficiency of each of the subterranean production zones.

9. The method of claim 5, further comprising:

performing a cleanup operation on the wellbore; and based on the determining the specific input of each of the subterranean production zones and the quantity of the respective different nanotag tracers remaining in the respective subterranean production zone, determining a cleanup efficiency of the cleanup operation.

10. The method of claim 1, before sequentially injecting the plurality of different nanotag tracers into the plurality of subterranean production zones fluidly coupled to the wellbore, the method further comprises:

perforating a casing of the wellbore; and responsive to perforating the casing, fluidly coupling each of the plurality of subterranean production zones to the wellbore, wherein sequentially injecting the plurality of different nanotag tracers into the plurality of subterranean production zones comprises sequentially injecting the plurality of different nanotag tracers into the plurality of subterranean production zones through the perforations, and sequentially hydraulically fracturing the plurality of subterranean production zones.

11. The method of claim 10, wherein sequentially hydraulically fracturing one or more of the plurality of subterranean production zones to inject the plurality of different nanotag tracers into the plurality of subterranean production zones comprises:

after sequentially hydraulically fracturing each of the plurality of subterranean production zones from a downhole production zone to an uphole production zone relative to the downhole production zone in an uphole direction toward the surface, placing a plug in the wellbore between the downhole production zone and the uphole production zone to seal the wellbore; and initiating a flow of production fluids from the subterranean production zones into the wellbore to the surface by milling the plug positioned in the wellbore.

12. A system comprising:

a nanotag tracer injection system comprising:

a fracturing liquid tank containing a fracturing liquid; and a plurality of nanotag tracer fluid tanks fluidly coupled to the fracturing liquid tank, each of the plurality of nanotag tracer fluid tanks comprising a different nanotag tracer fluid, each of the different nanotag tracer fluids comprising a different nanotag tracer;

a surface pump coupled to the fracturing liquid tank and configured to flow the fracturing liquid and the different nanotag tracer fluids into a wellbore extending from a surface of the Earth through a plurality of subterranean production zones;

a nanotag tracer and fluid analysis system comprising:

a sensor at the surface of the Earth, the sensor positioned to sense a condition of a production fluid flow from the wellbore, the production fluid flow containing fluids from one or more of the subterranean production zones and the respective plurality of nanotag tracer fluids; and a controller operably coupled to the nanotag tracer injection system, the surface pump, and the nanotag tracer and fluid analysis system, the controller configured to perform operations comprising:

sequentially injecting the different nanotag tracer fluids from the plurality of nanotag tracer fluid tanks into the plurality of subterranean production zones;

controlling a flow of the different nanotag tracer fluids and production fluids contained within one or more of the subterranean production zones through the wellbore to the surface;

determining a turbidity of the flow of production fluids containing the different nanotag tracers at the surface;

determining a quantity of each of the one or more different nanotag tracers from each of the plurality of subterranean production zones in the flow of production fluids at the surface; and determining, based on the turbidity of the flow of production fluids and the quantity of each of the one or more different nanotag tracers, a total oil production rate from the plurality of subterranean production zones by training a dataset of solutions with various turbidities relative to total oil production rates and expected quantities of each of the one or more different nanotag tracers, wherein the turbidity of the production fluids is proportional to the total oil production rate from the subterranean production zones.

13. The system of claim 12, wherein the sensor further comprises:

a transparent capillary;

a light source positioned to transmit light onto the transparent capillary;

a light detector positioned relative to the light source and the transparent capillary to receive light from the light source that has passed through the transparent capillary; and wherein the controller is further configured to perform operations comprising determining, at the surface, the turbidity of the flow of production fluids containing the different nanotag tracers by:

controlling a flow of a portion of the flow of production fluids at the surface through the transparent capillary;

transmitting a light onto the portion of the flow of production fluids in the transparent capillary;

detecting an intensity of the light transmitted through the transparent capillary;

comparing the intensity of the light transmitted through the transparent capillary with a threshold intensity to obtain a comparison result; and based on the comparison result, determining the turbidity of the flow of the production fluids.

14. The system of claim 13, wherein the threshold intensity is the intensity of light transmitted through a sample of clear water passed through the transparent capillary.

15. The system of claim 13, wherein flowing the portion of the flow of the production fluids comprises flowing the portion of the flow of the production fluids in parallel with the flow of production fluids at the surface.

16. The system of claim 12, wherein determining the quantity of each of the one or more different nanotag tracers from each of the plurality of subterranean production zones in the flow of production fluids comprises:

detecting specific wavelength characteristics for emissions from each of the different nanotag tracers;

recording specific wavelength characteristics for the emissions from each of the different nanotag tracers;

quantifying the specific wavelength characteristics for the emissions from each of the different nanotag tracers;

comparing the quantification of the specific wavelength characteristics for the emissions from each of the different nanotag tracers to an intensity of light passed through the production fluids; and based on the result of the comparison, determining a specific input of each of the subterranean production zones to the total oil production rate from the subterranean production zones.

17. The system of claim 16, wherein detecting specific wavelength characteristics for the emissions from each of the different nanotag tracers comprises detecting an ultraviolet light characteristic for the emissions from each of the different nanotag tracers.

18. The system of claim 16, wherein determining the specific input of each of the subterranean production zones to the total oil production rate from the subterranean production zones further comprises:

comparing the specific input of each of the subterranean production zones to an expected oil production rate from each of the subterranean production zones; and based on the result of the comparison, determining that a quantity of the respective different nanotag tracers remain in the respective subterranean production zone indicating the respective subterranean production zone is not contributing to the total oil production rate.

* * * * *